US005806679A

United States Patent [19]

Pavel

[11] Patent Number: 5,806,679

[45] Date of Patent: Sep. 15, 1998

[54] DISPLAY PACKAGE

[76] Inventor: Solomon L. Pavel, 768 39th St., Brooklyn, N.Y. 11232

[21] Appl. No.: 931,604

[22] Filed: Sep. 16, 1997

[51] Int. Cl.[6] ..... B65D 75/00

[52] U.S. Cl. ..... 206/461; 206/806

[58] Field of Search ..... 206/457, 461–471, 206/775, 806

[56] References Cited

U.S. PATENT DOCUMENTS

| | | | |
|---|---|---|---|
| D. 262,095 | 12/1981 | Takhashi | D9/303 |
| D. 302,118 | 7/1989 | Myman | D9/414 |
| D. 306,825 | 3/1990 | Siegel | D9/345 |
| D. 310,481 | 9/1990 | Chanel | D9/341 |
| D. 334,535 | 4/1993 | Piccione et al. | D9/415 |
| D. 370,625 | 6/1996 | Kelsey et al. | D9/341 |
| 2,078,488 | 4/1937 | Farnham | 229/6 |
| 3,116,824 | 1/1964 | Pacelli | 206/461 |
| 3,397,671 | 8/1968 | Hartman, Jr. et al. | 116/121 |
| 3,840,114 | 10/1974 | Sama | 206/461 |
| 3,931,885 | 1/1976 | Nahill et al. | 206/44 |

*Primary Examiner*—Jimmy G. Foster
*Attorney, Agent, or Firm*—Cobrin Gittes & Samuel

[57] ABSTRACT

A display package that includes a sheet backing divided into a plurality of sections, each configured to allow the sections to be severed individually or in groups from the rest of the backing and each is arranged relative to each other in rows and columns. Each section holds an item of merchandise, food or medicine within an associated plastic bubble or blister secured to the particular section. The bubbles or blisters are spaced apart from each other. The borders between adjacent sections are removably connected to each other along a relatively narrow region and separated from each other elsewhere by a relatively wide gap.

9 Claims, 3 Drawing Sheets

DISPLAY PACKAGE

BACKGROUND OF THE INVENTION

1. Field of the Invention

The present invention relates to a display package that includes a sheet with plastic bubbles or blisters. The sheet is divided into rows and columns and configured to allow individual items of merchandize, such as earrings, charms, fasteners, contained within the blisters to be removed individually or in groups from the rest of the sheet.

2. Discussion of Related Art

At the retail level, it is important for good consumer relations for the retailer to stock spares of small merchandise items, such as earring backs, screws, etc. These spares are burdensome for the retailer to stock because of their relatively small size. However, the failure of the retailer to stock them could mean that the spares will not be available from the manufacturer in the future at a time when the original product purchased by the consumer is discontinued by the manufacturer, but the consumer is in need of the spare part.

Retailers stock many spares of small items of consumer merchandise. However, if the small items are packaged individually, such packages, are more easily lost or misplaced by the retailer than if they were contained in large packages. This is analogous to the consumer being more prone to lose or misplace a small item of merchandise than a large one and thus requiring a spare. On the other hand, large packages that contain only a single small item of merchandise waste shelf space, although they are less likely to be lost or misplaced by the retailer.

Conventional display packages include a rectangular sheet of cardboard to which is secured plastic bubbles or blisters. Each bubble or blister is separated from each other by perforations. These perforations coincide with perforations in the cardboard. As a result, the cardboard and blister are divided into rows and columns by the perforations. Typically, a medicine tablet or the like is contained within the bubble and each section may be individually removed from the rest of the sheet or in groups.

SUMMARY OF THE INVENTION

One aspect of the invention relates to a display package that includes a sheet backing divided into a plurality of sections, each configured to allow the sections to be severed individually or in groups from the rest of the backing and each is arranged relative to each other in rows and columns. Each section preferably exhibits an attractive shape and holds an item of merchandise, food or medicine within an associated plastic bubble or blister secured to the particular section. The bubbles or blisters are spaced apart from each other. The borders between adjacent sections are removably connected to each other along a relatively narrow region and separated from each other elsewhere by a relatively wide gap.

BRIEF DESCRIPTION OF THE DRAWINGS

For a better understanding of the present invention, reference is made to the following description and accompanying drawings, while the scope of the invention is set forth in the appended claims.

DESCRIPTION OF THE PREFERRED EMBODIMENT

Figure 1:
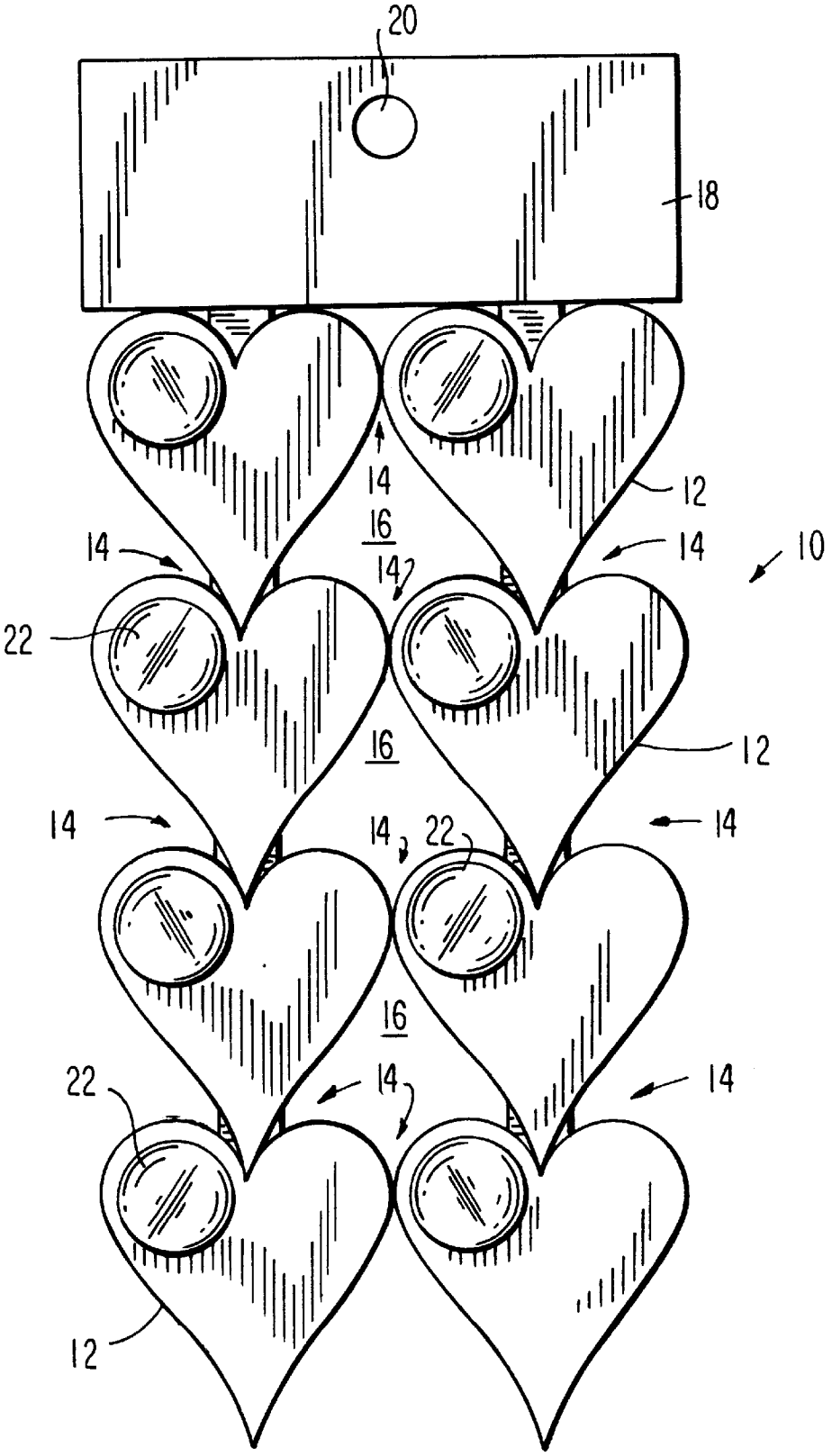
FIG. 1 shows the front side of the display package in accordance with the invention.

FIG. 1 shows a flat display sheet 10 cut into two columns and four rows of heart shape sections 12. While heart shape sections are illustrated, those of ordinary skill in the art will appreciate that other shapes which are round, diamond, triangular, star, etc. could also be employed instead. The borders of neighboring heart shape sections are joined together at individual, relatively small connection regions 14 and are elsewhere separated from each other by relatively large gaps 16. A hang card portion 18 is removably secured to each column and has an aperture 20 through which may be inserted a display stand rod to allow the hang card portion 18 to hang from it, with the columns extending underneath. While one rod is intended to be used with the hang card portion 18 shown, a pair of rods or other form of cantilever may be employed instead with appropriate modification of the aperture configuration as necessary. The display sheet 10 may be made of cardboard.

A plastic bubble or blister 22 is arranged on each of the heart shape sections 12 and spaced apart from each other. Each blister may be secured in any conventional manner to the display sheet, such as with an adhesive. Within each bubble may be contained merchandise such as earring backs, charms, food such as candy, or medicine such as that in the form of tablets.

The regions 14 are easily severed from each other under manual force, i.e., by tearing. Thus, a consumer may readily sever each heart shape section 12 or group of heart shape sections from the rest of the display sheet 10 by simply tearing once at the appropriate regions 14 between neighboring sections 12, e.g., by pulling the neighboring sections in opposite directions while holding the sections in the vicinity of the region 14 to be severed. Indeed, any number of full or partial columns or rows may be separated from the remainder at one time. The consumer therefore has the ability of taking just the number desired at any one time.

Figure 2:
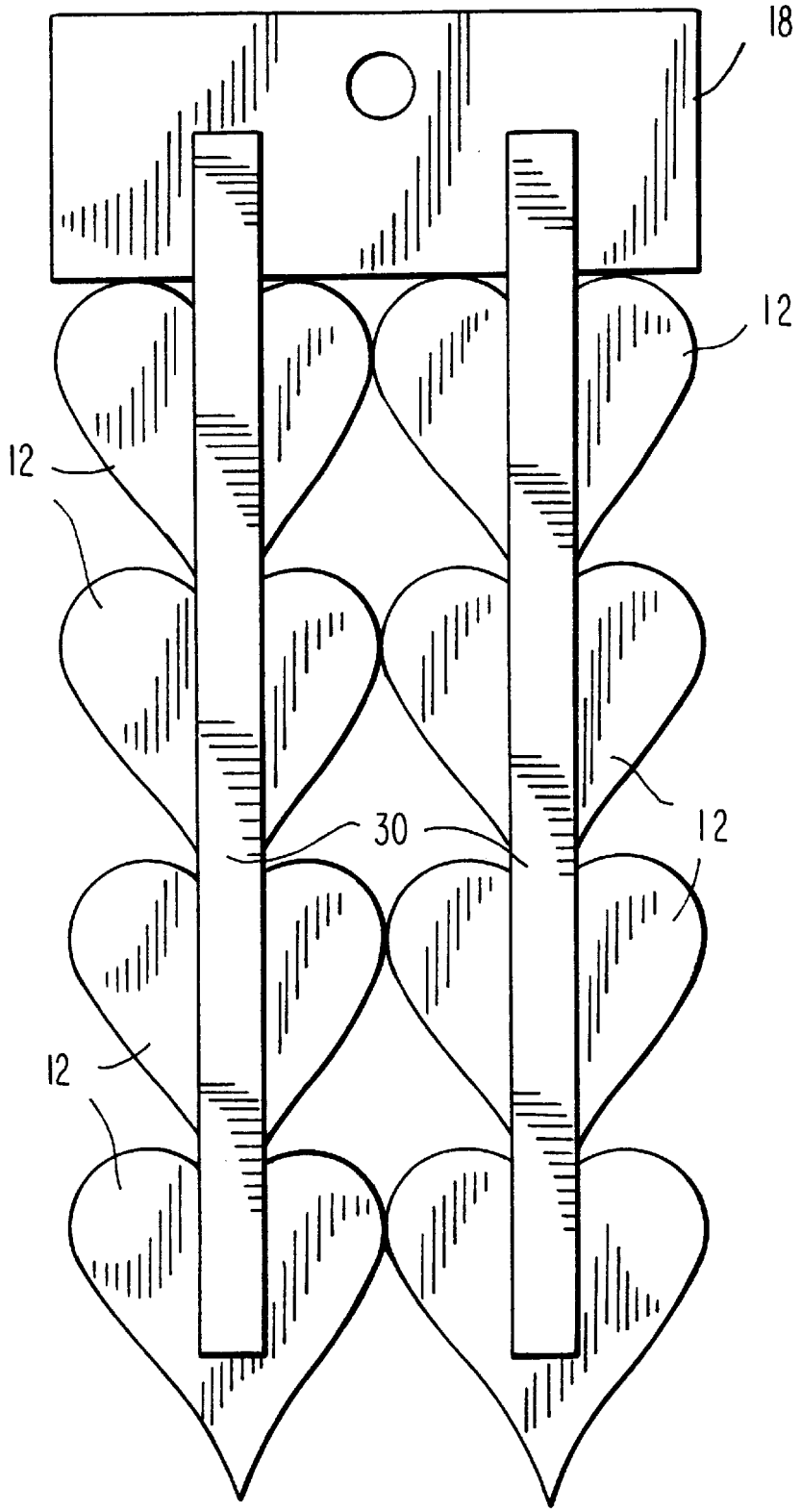
FIG. 2 shows the rear side of the display package in accordance with the invention.

In addition, FIG. 2 shows a tape 30 that is secured to the display sheet and extends along its full length. Thus, removal of the sections may only be done from the bottom up, because the tape cannot be torn readily in the middle, only from the bottom. This is advantageous since it avoids severing the display sheet at the top or middle before the bottom is removed because the tape needs to be removed with the display sheet sections to permit removal of the sections. Preferably, the tape is a heavy packaging tape, such as that manufactured by 3M under the brand Scotch 3750. Preferably, thin strips are used that are adhered each to an associated one of the columns.

When hung in a retail store, a consumer could take just the number of sections desired from the display sheet and pay for just those, instead of being compelled to purchase the entire sheet. After removal, the display sheet still appears aesthetically pleasing, without giving the appearance of opened packaging, because each section is self-contained in the sense that the removal of the section does not leave behind perforations in the blister or sheet that may suggest that the integrity of the package has been compromised.

As a consequence, the retailer has the ability to maximize hanging shelf space, without resorting to stocking the same items individually or in groups of different quantities. Conventionally, such stocking of items individually or in multiple display packages of different quantities was necessary to cater to the needs of the consumer, who may be interested in purchasing items only individually or in groups.

Although the sections 12 are shown in the form of heart shapes, they may instead be any configuration that would still leave gaps between the neighboring borders, such as circles, diamonds, hexagons, triangles, stars, etc. The aperture 20 may be replaced by any conventional technique to hang the hang card portion from a single rod or cantilever rod, such as a hook-like recess opening from the top edge.

Figure 3:
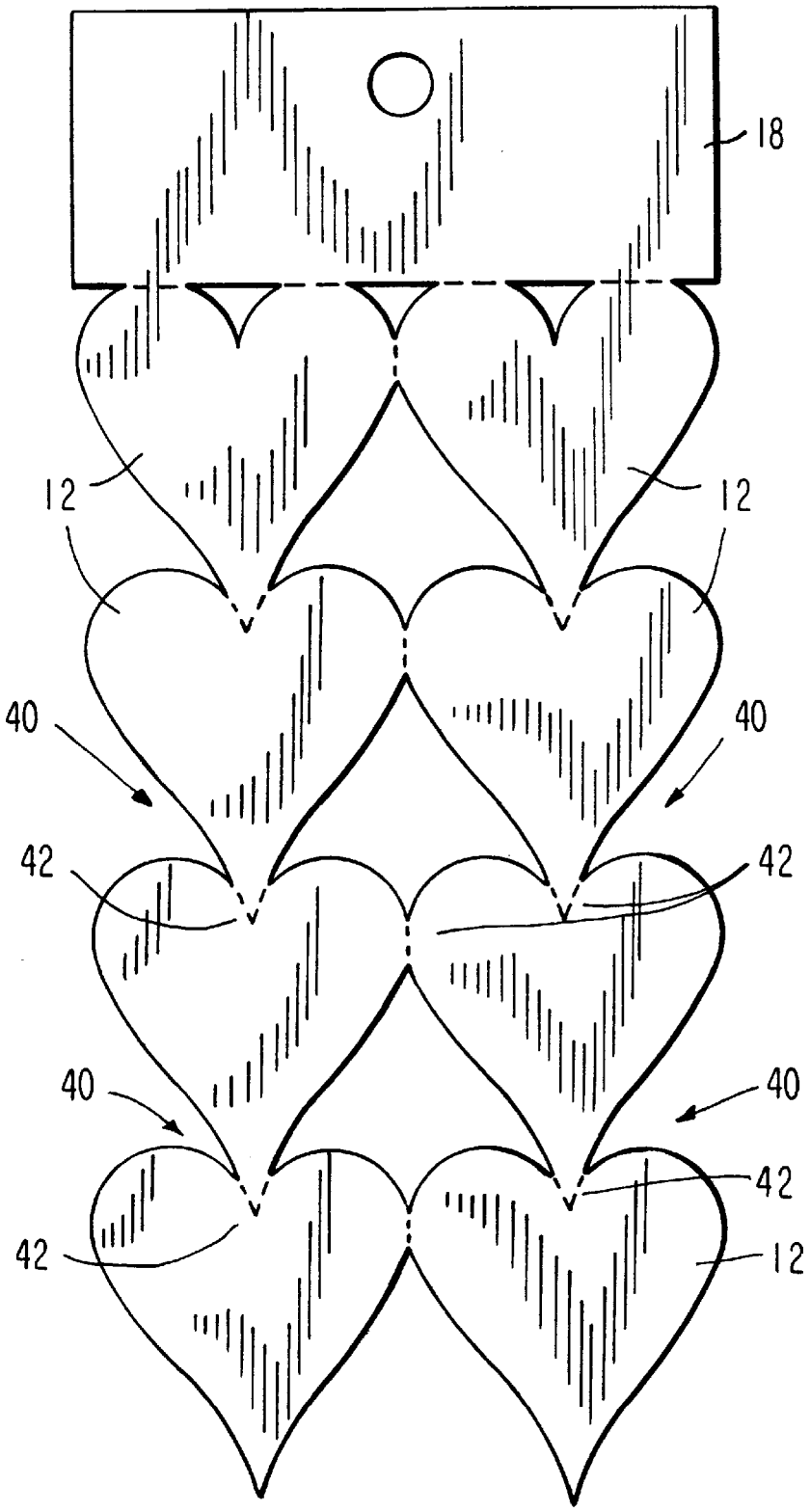
FIG. 3 shows a front side of the display package in accordance with a further embodiment.

The embodiment of FIG. 3 shows a backing sheet that is substantially flat, but has connection regions 40 that are stronger than the connection regions 14 of the embodiment of FIGS. 1 and 2. This is attributed to the use of perforations 42 together with a wider surface area of attachment. As a consequence, the connection regions 40 are still easily torn under manual force, but the longer area of connection provides sufficient stability to avoid the need for the added stability provided by the tape 30 of the embodiment of FIG. 2.

Preferably, the perforations 42 extend in line with the borders of the shapes defied by the sections 12 so as to provide a continuation of the same curvature or contour as the borders. In this manner, severing the perforations 42 results in a retention of the overall desired shape of each section.

While the foregoing description and drawings represent the preferred embodiments of the present invention, various changes and modifications may be made without departing from the spirit and scope of the present invention.

What is claimed is:

1. A display package, comprising:

a backing sheet having a plurality of sections each having borders, said borders of neighboring ones of said sections having regions connecting each other and defining gaps between said regions, said regions each being formed to sever in response to an application of manual tearing forces at desired ones of said regions;

plastic bubbles or blisters mounted respectively onto said sections each containing an item, said plastic bubbles or blisters being spaced from each other and being free from connecting with each other at said regions so as to avoid tearing in response to said manual tearing forces being applied at said desired ones of said regions; and a hang card attached to said backing sheet and having a portion with a configuration that accommodates insertion of a horizontally disposed rod to allow said hang card to hang from said rod with said backing sheet extending underneath.

2. A display package as in claim 1, wherein said configuration is an aperture.

3. A display package as in claim 1, wherein said configuration is a hook-shaped recess.

4. A display package as in claim 1, wherein said backing sheet defines at least two columns of said sections and two rows of said sections, said hang card being attached to said two columns.

5. A display package as in claim 1, wherein said borders of neighboring ones of said sections that face each other have at most one of said regions connecting each other.

6. A display package as in claim 1, wherein said sections are severable from a remainder of said backing sheet at said regions individually and in groups as desired.

7. A display package as in claim 1, further comprising a tape secured to all the sections of said backing sheet.

8. A display package as in claim 1, wherein said regions each have perforations.

9. A display package as in claim 8, wherein sections each define a shape defined by said borders and said perforations, said perforations extending in line with said borders in conformance with said shape.

* * * * *